US006330420B1

(12) United States Patent
Honda

(10) Patent No.: US 6,330,420 B1
(45) Date of Patent: Dec. 11, 2001

(54) IMAGE FORMING APPARATUS

(75) Inventor: Mitsunobu Honda, Suita (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/644,825

(22) Filed: Aug. 24, 2000

(30) Foreign Application Priority Data

Sep. 28, 1999 (JP) ..... 11-275045

(51) Int. Cl.[7] ..... G03G 21/10
(52) U.S. Cl. ..... 399/346
(58) Field of Search ..... 399/346, 345, 399/341

(56) References Cited

FOREIGN PATENT DOCUMENTS 7-160165 6/1995 (JP) .
8-305233 11/1996 (JP) .

*Primary Examiner*—Quana M. Grainger
(74) *Attorney, Agent, or Firm*—McDermott, Will & Emery

(57) ABSTRACT

An image forming apparatus according to the present invention comprises an image carrying member for carrying a toner image, a cleaning blade for separating toners remaining on the image carrying member, and a lubricant supplying device for supplying to the image carrying member a lubricant for preventing the image carrying member and the cleaning blade from mutually wearing.

19 Claims, 6 Drawing Sheets

IMAGE FORMING APPARATUS

BACKGROUND OF THE INVENTION

This application is based on application No. 275045/1999 filed in Japan, the contents of which is hereby incorporated by reference.

1. Field of the Invention

The present invention relates generally to an image forming apparatus such as an electrophotographic copying machine or a printer, and more particularly, to an image forming apparatus so adapted as to supply toners to an image carrying member from a developing device, form a toner image on a surface of the image carrying member, transfer the toner image to a recording medium from the image carrying member, press a pressing member against the surface of the image carrying member after the transfer, and remove the toners remaining on the surface of the image carrying member, characterized in that the pressing member is prevented from immediately wearing and causing irregularities in the surface of the image carrying member, to stably remove the toners remaining on the surface of the image carrying member.

2. Description of the Related Art

In a conventional example of image forming apparatuses such as electrophotographic copying machines or printers, an image carrying member 10 in which a photoreceptor 12 is formed on a surface of a conductive base member 11 in a drum shape is rotated, a surface of the image carrying member 10 is charged by a charging device 20, and the surface of the image carrying member 10 is then subjected to exposure corresponding to image information by a latent image forming device 30 using a laser or the like, to form an electrostatic latent image on the surface of the image carrying member 10, as shown in FIG. 1. Toners 41 are supplied to the surface, on which the electrostatic latent image has been thus formed, of the image carrying member 10 from a developing device 40, to form a toner image corresponding to the electrostatic latent image on the surface of the image carrying member 10.

Thereafter, a recording medium 51 such as a recording paper sheet is introduced into a portion between the image carrying member 10 and a transferring device 50 such as a transfer roller by a feed roller 52, to transfer the toner image formed on the surface of the image carrying member 10 to the recording medium 51 by the transferring device 50.

The toner image which has been thus transferred to the recording medium 51 is then fixed to the recording medium 51 by a fixing device 60 such as a fixing roller. On the other hand, a pressing member 70 in a plate shape is pressed against the surface of the image carrying member 10 after the transfer, to remove the toners 41 or the like remaining on the surface of the image carrying member 10 from the surface of the image carrying member 10. Thereafter, the surface of the image carrying member 10 is charged by the charging device 20, as described above. The above-mentioned operations are repeated, to successively form toner images.

When the pressing member 70 is pressed against the surface of the image carrying member 10, to remove the toners 41 or the like remaining on the surface of the image carrying member 10 from the surface of the image carrying member 10, as described above, the pressing member 70 which is pressed against the image carrying member 10 gradually wears, so that the toners 41 or the like remaining on the surface of the image carrying member 10 cannot be sufficiently removed. Further, the pressing member 70 causes irregularities in the surface of the image carrying member 10. The irregularities prevent the toners 41 or the like from being suitably removed by the pressing member 70. Consequently, noise based on insufficient cleaning appears in the formed toner image.

In recent years, in supplying a lubricant to the surface of the image carrying member 10 and passing the lubricant through the pressing member 70, the lubricant has been rolled by the pressing member 70, to form a film of the lubricant on the surface of the image carrying member 10. The film of the lubricant has prevented the pressing member 70 from wearing and causing irregularities in the surface of the image carrying member 10.

In the conventional example, in supplying the lubricant to the surface of the image carrying member 10, the lubricant is added to the toners 41 in the developing device 40, and the lubricant, together with the toners 41, is supplied to the surface of the image carrying member 10, as in the image forming apparatus shown in FIG. 1. Alternatively, the lubricant is scraped off a molding 81 of the lubricant by a brush 82, and the lubricant is supplied to the surface of the image carrying member 10 from the brush 82, as shown in FIG. 2.

When the lubricant is added to the toners 41, as described above, however, the performance of the toners 41 changes depending on the type of the lubricant. Consequently, a good toner image cannot be obtained.

When the lubricant, together with the toners 41, is supplied to the surface of the image carrying member 10, in a state where the toners 41 or the like remaining on the surface of the image carrying member 10 after the transfer are removed from the surface of the image carrying member 10 by the pressing member 70, the toners 41, a post-treatment agent added to the toners 41, and so forth are stored in a contact portion between the pressing member 70 and the image carrying member 10. In the portion where the toners 41, the post-treatment agent, and so forth are stored, the lubricant is not introduced into the pressing member 70. Accordingly, the film of the lubricant is not satisfactorily formed on the surface of the image carrying member 10. Consequently, the pressing member 70 still wears and causes irregularities in the surface of the image carrying member 10.

In scraping the lubricant off the molding 81 of the lubricant by the brush 82 and supplying the lubricant to the surface of the image carrying member 10, as described above, the lubricant is always supplied to the surface of the image carrying member 10 by the brush 82 in the conventional example.

In a state where the toner image is formed, however, the toners 41, the post-treatment agent, and so forth are stored in the contact portion between the pressing member 70 and the image carrying member 10, as described above. Accordingly, the film of the lubricant is not satisfactorily formed on the surface of the image carrying member, as in the above-mentioned case. Consequently, the lubricant is uselessly consumed.

When the lubricant is scraped off the molding 81 of the lubricant by the brush 82 and is supplied to the surface of the image carrying member 10, as described above, the particle diameter of the lubricant supplied to the surface of the image carrying member 10 by the brush 82 is not fixed. Accordingly, the lubricant having a large particle diameter, together with the toners 41, is removed from the surface of the image carrying member 10 by the pressing member 70. On the other hand, the lubricant 70 having a small particle diameter is not satisfactorily rolled by the pressing member 70. Consequently, the film of the lubricant is not suitably formed on the surface of the image carrying member 10.

Furthermore, in scraping the lubricant off the molding 81 of the lubricant by the brush 82 and supplying the lubricant to the surface of the image carrying member 10, as described above, if the diameter of the image carrying member 10 to be used is small, the places where the brush 82 and the molding 81 of the lubricant are provided are a problem.

SUMMARY OF THE INVENTION

A first object of the present invention is to provide an image forming apparatus for supplying toners to an image carrying member from a developing device to form a toner image on a surface of the image carrying member, transferring the toner image to a recording medium from the image carrying member, and pressing a pressing member against the surface of the image carrying member after the transfer, to remove the toners remaining on the surface of the image carrying member, wherein in supplying the lubricant to the surface of the image carrying member, and rolling the lubricant by the pressing member, the lubricant is efficiently introduced into the pressing member and is suitably rolled, to suitably form a film of the lubricant on the surface of the image carrying member.

A second object of the present invention is to prevent, in the above-mentioned image forming apparatus, the pressing member from wearing and causing irregularities in the surface of the image carrying member.

A third object of the present invention is to suitably remove, in the above-mentioned image forming apparatus, the toners remaining on the surface of the image carrying member by the pressing member, to stably obtain a good toner image in which no noise or the like based on insufficient cleaning appears.

A fourth object of the present invention is to suitably supply, in supplying the lubricant to the surface of the image carrying member in the above-mentioned image forming apparatus, the lubricant to the surface of the image carrying member even when the diameter of the image carrying member to be used is small.

A first image forming apparatus according to the present invention comprises an image carrying member for carrying a toner image; a cleaning blade for separating toners remaining on the image carrying member; and a lubricant supplying device for supplying to the image carrying member a lubricant for preventing the image carrying member and the cleaning blade from mutually wearing when no toner image is formed.

A second image forming apparatus according to the present invention comprises an image carrying member for carrying a toner image; a developing device for forming a toner image on the image carrying member; a cleaning blade for separating toners remaining on the image carrying member; and a lubricant supplying device for supplying a lubricant for preventing the image carrying member and the cleaning blade from mutually wearing to a portion, where the toner image is not formed, of the image carrying member.

A third image forming apparatus according to the present invention comprises an image carrying member for carrying a toner image; a transferring device for transferring the toner image carried on the image carrying member to a surface of a recording medium; a cleaning blade for separating toners remaining on the image carrying member after the toner image is transferred to the surface of the recording medium; and a lubricant supplying device for applying a lubricant for preventing the image carrying member and the cleaning blade from mutually wearing to the surface, to which the toner image has been transferred, of the recording medium, to supply the lubricant to the image carrying member through the surface of the recording medium.

A fourth image forming apparatus according to the present invention comprises an image carrying member for carrying a toner image; a cleaning blade for separating toners remaining on the image carrying member; and a lubricant supplying device for supplying to the image carrying member a lubricant containing not less than 80% by volume of particles having a particle diameter in a range of 3 $\mu$m to 20 $\mu$m in order to prevent the image carrying member and the cleaning blade from mutually wearing.

A first image forming method according to the present invention comprises the steps of forming a toner image on an image carrying member; transferring the toner image formed on the image carrying member to a surface of a recording medium; separating toners remaining on the image carrying member by a cleaning blade; and supplying a lubricant to a portion, where the toner image is not formed, of the image carrying member in order to prevent the image carrying member and the cleaning blade from mutually wearing.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

An image forming apparatus according to embodiments of the present invention will be specifically described on the basis of accompanying drawings.

(Embodiment 1)

Figure 1:
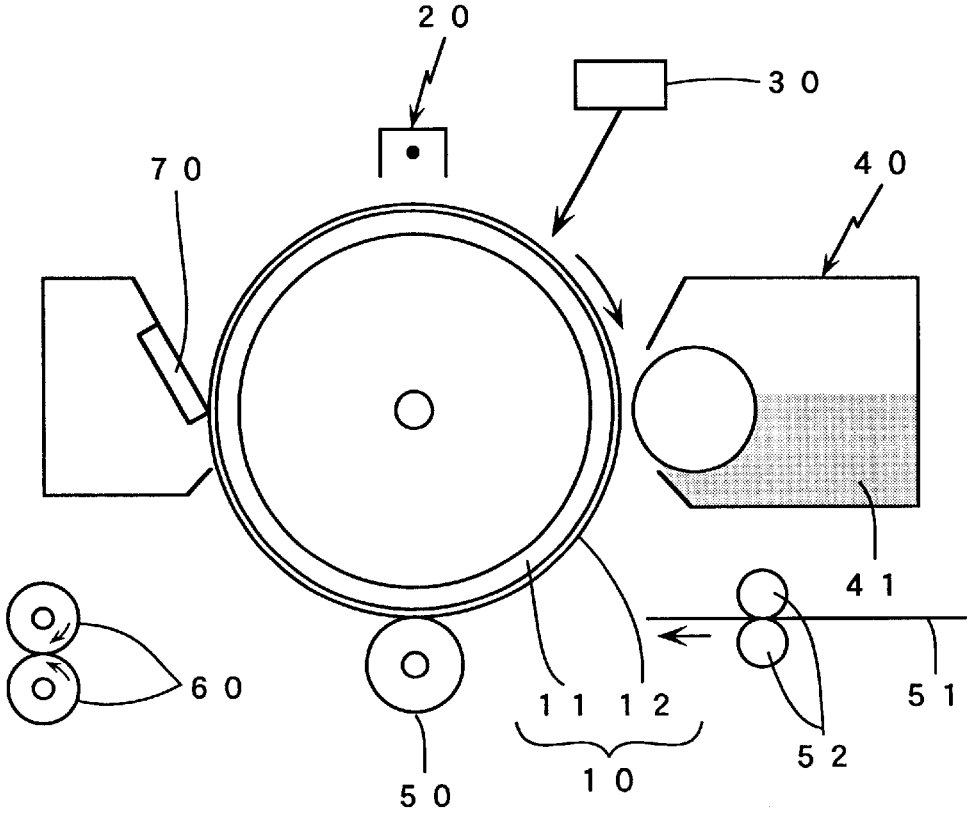
FIG. 1 is a schematic illustration of a conventional image forming apparatus.
Figure 2:
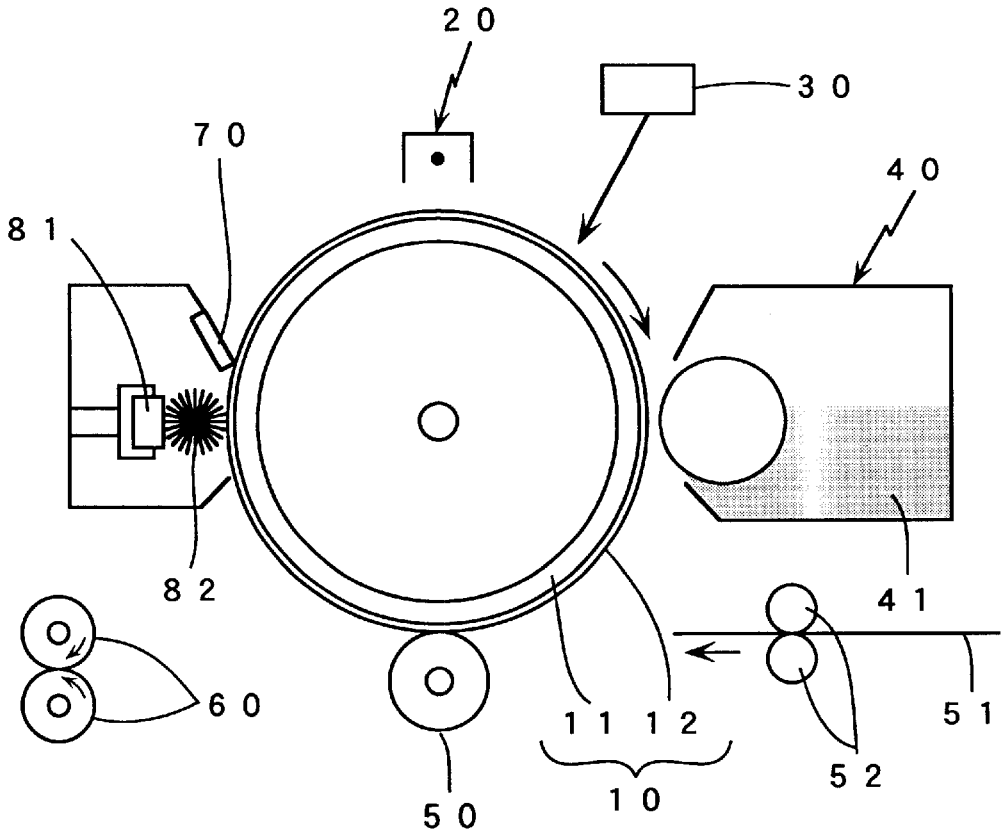
FIG. 2 is a schematic illustration of a conventional image forming apparatus so adapted as to scrape off a molding of a lubricant the lubricant by a brush and supply the scraped lubricant to a surface of an image carrying member.
Figure 3:
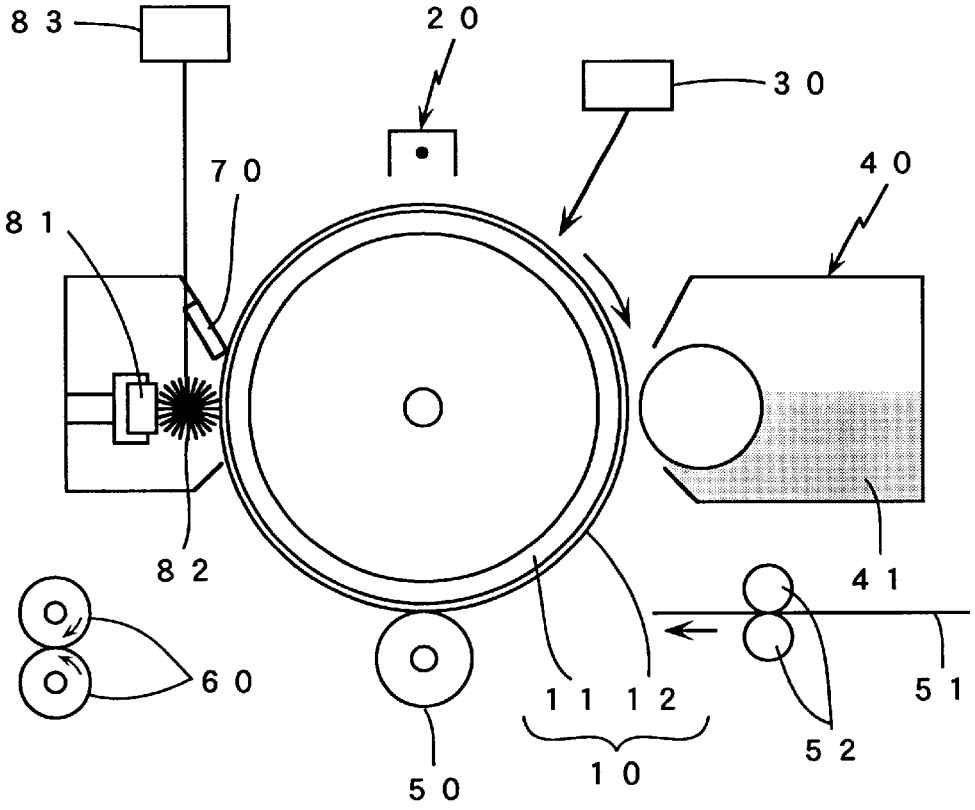
FIG. 3 is a schematic illustration of an image forming apparatus according to an embodiment 1 of the present invention.

In an image forming apparatus according to an embodiment 1, an image carrying member 10 in which a photosensitive layer 12 is formed on a surface of a conductive base member 11 in a drum shape is rotated, to charge a surface of the image carrying member 10 by a charging device 20, as in the image forming apparatus shown in FIGS. 1 and 2, as shown in FIG. 3.

The surface of the image carrying member 10 is subjected to exposure corresponding to image information by a latent image forming device 30 using a laser or the like, to form an electrostatic latent image on the surface of the image carrying member 10.

Toners 41 are then supplied from a developing device 40 to the surface, on which the electrostatic latent image has been thus formed, of the image carrying member, to form a toner image corresponding to the electrostatic latent image on the surface of the image carrying member 10.

A recording medium 51 such as a recording paper sheet is introduced into a portion between the image carrying member 10 and a transferring device 50 such as a transfer roller by a feed roller 52, to transfer the toner image formed on the surface of the image carrying member 10 to the recording medium 51 by the transferring device 50.

The toner image which has been thus transferred to the recording medium 51 is then fixed to the recording medium 51 by a fixing device 60 such as a fixing roller. On the other hand, a pressing member 70 in a plate shape is pressed against the surface of the image carrying member 10 after the transfer, to remove the toners 41 remaining on the surface of the image carrying member 10 from the surface of the image carrying member 10.

Thereafter, the surface of the image carrying member 10 is charged by the charging device 20. The above-mentioned operations are repeated, to form toner images.

In the image forming apparatus according to the embodiment 1, a brush 82 is brought into contact with the surface of the image carrying member 10 at a position on the upstream side in the direction of rotation of the image carrying member 10 from the pressing member 70, and a molding 81 of a lubricant is pressed against the brush 82, as shown in FIG. 3. The rotation of the brush 82 is controlled by a control device 83.

In the image forming apparatus according to the embodiment 1, the rotation of the brush 82 is stopped by the control device 83, not to supply the lubricant to the surface of the image carrying member 10 by the brush 82 in a state where the toner image is formed on the surface of the image carrying member 10, as described above.

On the other hand, the brush 82 is rotated by the control device 83, to scrape the lubricant off the molding 81 of the lubricant by the brush 82 and supply the scraped lubricant to the surface of the image carrying member 10 when no toner image is formed on the surface of the image carrying member 10 which rotates, for example, in a time period elapsed from the time when a toner image is formed on the surface of the image carrying member 10 until the subsequent toner image is formed or in a case where the image carrying member 10 is idled from the time when the power supply of the image forming apparatus is turned on until a toner image is formed.

If the lubricant is thus supplied to the surface of the image carrying member 10 only when no toner image is formed, the lubricant is not supplied to the surface, on which the toner image has been formed, of the image carrying member 10, thereby preventing the lubricant and the toners 41 from being mixed and stored in a contact portion between the pressing member 70 and the image carrying member 10. In a state where the amounts of the toners 41 thus stored in the contact portion between the pressing member 70 and the image carrying member 10, a post-treatment agent added to the toners 41, and so forth are significantly decreased, the lubricant is satisfactorily introduced into the portion between the pressing member 70 and the image carrying member 10, and is rolled by the pressing member 70. Accordingly, the lubricant is not uselessly consumed, and a film of the lubricant is uniformly formed on the surface of the image carrying member 10.

As a result, the pressing member 70 is prevented from wearing and causing irregularities in the surface of the image carrying member 10, thereby stably obtaining a good toner image in which no noise or the like based on insufficient cleaning appears.

Used as the above-mentioned lubricant are known ones conventionally generally used. Examples include long-chain hydrocarbons represented by petroleum waxes such as paraffin wax and microcrystalline wax, higher alcohols, which are solid at room temperature, such as stearyl alcohol and cetyl alcohol, higher fatty acids such as palmitic acid and stearic acid, higher fatty acid amides such as amide palmitate and amide stearate, higher fatty acid metal salts such as calcium stearate, zinc stearate, and zinc palmitate, vegetable, animal and mineral natural waxes such as carnaubic wax, bees wax, and montan wax, and polyethylene and polypropylene having a low molecular weight. Out of the lubricants, the stearic acid lubricant suitably rolled by the pressing member is preferably used, and particularly the calcium stearate is more preferably used.

When a lubricant containing not less than 80% by volume of particles having a particle diameter in a range of 3 $\mu$m to 20 $\mu$m is supplied to the surface of the image carrying member 10 as the above-mentioned lubricant, much of the lubricant supplied to the surface of the image carrying member 10 is introduced into a portion between the pressing member 70 and the image carrying member 10, and is suitably rolled by the pressing member 70. Accordingly, the lubricant is hardly uselessly used, and the film of the lubricant is uniformly formed on the surface of the image carrying member 10. As a result, the pressing member 70 is further prevented from wearing and causing irregularities in the surface of the image carrying member 10, thereby stably obtaining a good toner image in which no noise or the like based on insufficient cleaning appears.

Therefore, it is preferable that used as the molding 81 of the lubricant is a molding obtained by merely solidifying the lubricant containing not less than 80% by volume of particles having a particle diameter in a range of 3 $\mu$m to 20 $\mu$m without heating and melting the lubricant.

(Embodiment 2)

Figure 4:
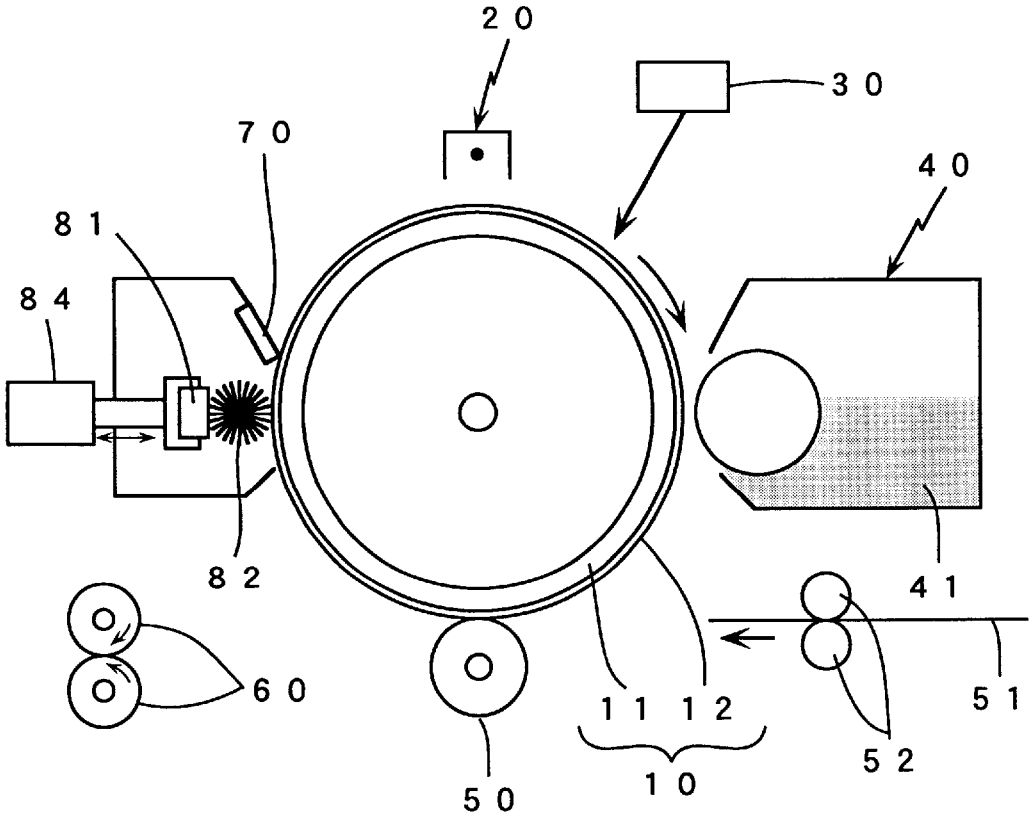
FIG. 4 is a schematic illustration of an image forming apparatus according to an embodiment 2 of the present invention.

Also in an image forming apparatus according to an embodiment 2, a lubricant is supplied to a surface of an image carrying member 10 which rotates only when no toner image is formed of toners 41 on the surface of the image carrying member 10, as in the above-mentioned image forming apparatus according to the embodiment 1 shown in FIG. 3, as shown in FIG. 4.

In the image forming apparatus according to the embodiment 2, a brush 82 which rotates is brought into contact with the surface of the image carrying member 10 at a position on the upstream side in the direction of rotation of the image carrying member 10 from the pressing member 70, and a molding 81 of the lubricant to be pressed against the brush 82 is held in an expanding and contracting device 84, as shown in FIG. 4.

In the image forming apparatus according to the embodiment 2, when a toner image is formed on the surface of the image carrying member 10, the expanding and contracting device 84 is contracted, to separate the molding 81 of the lubricant from the brush 82 which rotates, thereby preventing the lubricant from being scraped off the molding 81 of the lubricant by the brush 82 and being supplied to the surface of the image carrying member 10.

On the other hand, when no toner image is formed on the surface of the image carrying member 10 which rotates, the expanding and contracting device 84 is expanded, to bring the molding 81 of the lubricant into contact with the brush 82 which rotates, thereby scraping the lubricant off the molding 81 of the lubricant by the brush 82 and supplying the scraped lubricant to the surface of the image carrying member 10.

It will be clarified by comparison with image forming apparatuses in comparative examples 1 and 2 that according to image forming apparatuses in examples 1 and 2 so adapted as to supply a lubricant to a surface of an image carrying member 10 which rotates only when no toner image is formed on the surface of the image carrying member 10, as shown in the above-mentioned embodiments 1 and 2, the lubricant is not uselessly consumed and is suitably rolled by a pressing member 70, thereby uniformly forming a film of the lubricant on the surface of the image carrying member 10.

EXAMPLES 1 AND 2 AND COMPARATIVE EXAMPLES 1 AND 2

In the image forming apparatuses in the examples 1 and 2 and the comparative examples 1 and 2, a commercial color copying machine (CF900: manufactured by Minolta Camera Co., Ltd.) was converted, to bring a brush 82 into contact with a surface of an image carrying member 10 such that the contact length of its bristles would be approximately 1 mm at a position on the upstream side in the direction of rotation of the image carrying member 10 from a pressing member 70.

In the examples 1 and 2 and the comparative example 1, used as a lubricant was a molding 81 in the shape of a rectangular parallelepiped having dimensions of 5 mm by 5 mm by 300 mm obtained by solidifying calcium stearate powder (CS-P: produced by Sinagawa Kako K.K.). In the comparative example 2, the above-mentioned lubricant was not used.

In the image forming apparatus in the example 1, the molding 81 of the lubricant was pressed against the brush 82 by a pressing force of approximately 200 gf. In a state where a toner image was formed on the surface of the image carrying member 10, the brush 82 was not rotated by a control device 83, not to supply the lubricant to the surface of the image carrying member 10. On the other hand, when no toner image was formed on the surface of the image carrying member 10 which rotates, the brush 82 was rotated at a speed of 10 r.p.m. so as to be moved in the same direction as the image carrying member 10 in a portion in contact with the image carrying member 10 by the control device 83, to scrape the lubricant off the molding 81 of the lubricant by the brush 82 and supply the scraped lubricant to the surface of the image carrying member 10.

In the image forming apparatus in the example 2, the brush 82 was rotated at a speed of 10 r.p.m. so as to be moved in the same direction as the image carrying member 10 in a portion in contact with the image carrying member 10. As shown in the above-mentioned embodiment 2, the expanding and contracting device 84 was contracted, to separate the molding 81 of the lubricant from the brush 82 which rotates, not to supply the lubricant to the surface of the image carrying member 10 by the brush 82 in a state where the toner image was formed on the surface of the image carrying member 10, while being expanded, to press the molding 81 of the lubricant against the brush 82 by a pressing force of approximately 200 gf, to scrape the lubricant off the molding 81 of the lubricant by the brush 82 and supply the scraped lubricant to the surface of the image carrying member 10 when no toner image was formed on the surface of the image carrying member 10 which rotates.

In the image forming apparatus in the comparative example 1, either at the time of forming a toner image or at the time of forming no toner image, the brush 82 was rotated at a speed of 10 r.p.m. so as to be moved in the same direction as the image carrying member 10 in a portion in contact with the image carrying member 10, and the molding 81 of the lubricant was pressed against the brush 82 by a pressing force of approximately 200 gf, to scrape the lubricant off the molding 81 of the lubricant by the brush 82 and always supply the scraped lubricant to the surface of the image carrying member 10.

In the image forming apparatus in the comparative example 2, either at the time of forming a toner image or at the time of forming no toner image, the brush 82 was merely rotated at a speed of 10 r.p.m. so as to be moved in the same direction as the image carrying member 10 in a portion in contact with the image carrying member 10, not to supply the lubricant to the surface of the image carrying member 10.

A plate wear test of 40,000 paper sheets was carried out by each of the image forming apparatuses in the examples 1 and 2 and the comparative examples 1 and 2, to examine the state of a formed toner image, the consumption of the lubricant, and the state of a film of the lubricant formed on the surface of the image carrying member 10.

As a result, in the image forming apparatuses in the examples 1 and 2, even at the time point where a toner image was formed on 40,000 paper sheets, no noise due to insufficient cleaning appeared in the formed toner image. Further, the consumption of the lubricant was approximately 10 g, and the thickness of the film of the lubricant formed on the surface of the image carrying member 10 hardly varied. The thickness of the film of the lubricant was an average of 0.100 $\mu$m in the example 1, while being an average of 0.097 $\mu$m in the example 2.

On the other hand, in the image forming apparatus in the comparative example 1, the consumption of the lubricant was large, for example, approximately 13 g, and the thickness of the film of the lubricant formed on the surface of the image carrying member 10 varied more greatly than those in the examples 1 and 2. In the image forming apparatus in the comparative example 2, at the time point where a toner image was formed on approximately 30,000 paper sheets, noise due to insufficient cleaning appeared in the formed toner image.

(Embodiment 3)

Figure 5:
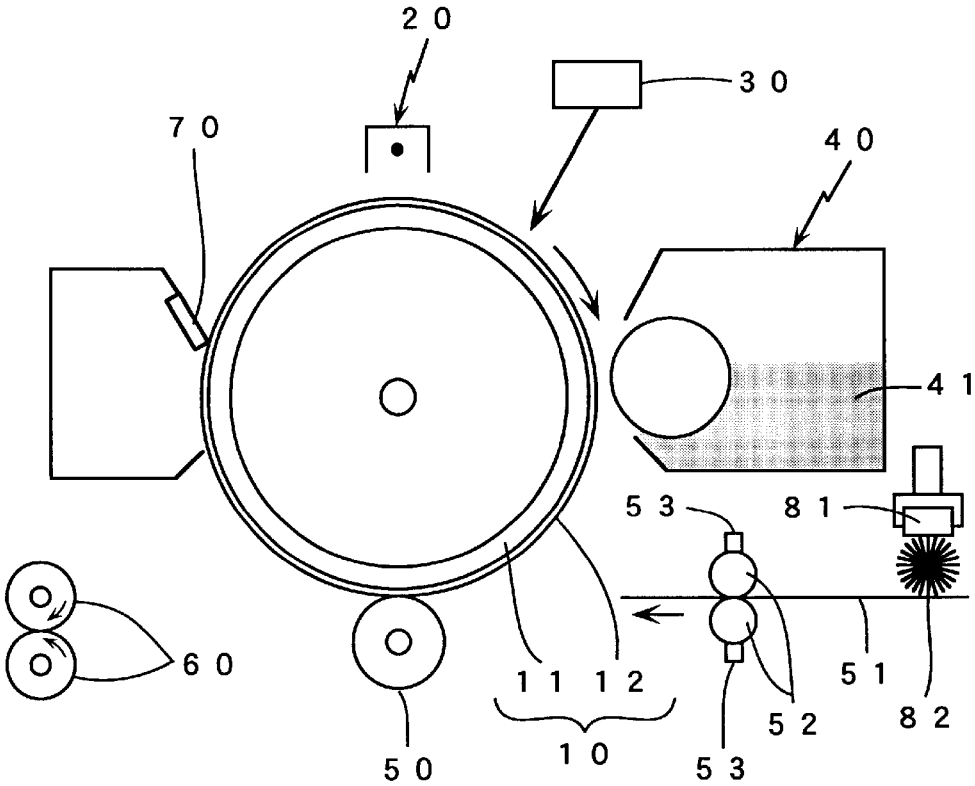
FIG. 5 a schematic illustration of an image forming apparatus according to an embodiment 3 of the present invention.

Also in an image forming apparatus according to an embodiment 3, a toner image corresponding to an electrostatic latent image is also formed of toners 41 on a surface of an image carrying member 10, as in the above-mentioned image forming apparatuses according to the embodiments 1 and 2, as shown in FIG. 5.

In the image forming apparatus according to the embodiment 3, at a position in a time period elapsed until a recording medium 51 such as a paper sheet is introduced into a portion between the image carrying member 10, on which the toner image has been formed as described above, and a transferring device 50 by a feed roller 52, a brush 82 is brought into contact with a surface, to which the toner image formed on the image carrying member 10 is transferred, of the recording medium 51, and a molding 81 of the lubricant is pressed against the brush 82, as shown in FIG. 5. Further, a recovering sponge 53 is brought into contact with the feed roller 52.

The brush 82 is rotated, to scrape the lubricant off the molding 81 of the lubricant. The lubricant thus scraped is supplied to the surface, to which the toner image is transferred, of the recording medium 51 by the brush 82. The recording medium 51 to which the lubricant has been thus supplied is then fed to the portion between the image carrying member 10, on which the toner image has been formed, and the transferring device 50 by the feed roller 52, and paper powder or the like existing on the recording medium 51 is recovered in the recovering sponge 53 through the feed roller 52.

In such a case, the lubricant supplied to the recording medium 51 is supplied to a surface of the feed roller 52, to form a film of the lubricant on the surface of the feed roller 52. Consequently, the paper powder or the like adhering to the surface of the feed roller 52 from the recording medium 51 is suitably recovered in the recovering sponge 53 through the feed roller 52.

The recording medium 51 is introduced into the portion between the image carrying member 10, on which the toner image has been formed, and the transferring device 50, to transfer the toner image formed on the image carrying member 10 to the recording medium 51. On the other hand, the lubricant supplied to the recording medium 51 is supplied to the surface of the image carrying member 10.

The toner image which has been thus transferred to the recording medium 51 is then fixed to the recording medium 51 by a fixing device 60. When the toner image which has been thus transferred to the recording medium 51 is fixed to the recording medium 51 by the fixing device 60, offset of the toner image is prevented from occurring by the lubricant remaining on the recording medium 51.

A pressing member 70 in a plate shape is pressed against the surface of the image carrying member 10 after the transfer, the toners 41 remaining on the surface of the image carrying member 10 are removed from the surface of the image carrying member 10 by the pressing member 70, and the lubricant supplied to the surface of the image carrying member 10 from the recording medium 51, as described above, is rolled by the pressing member 70, to form the film of the lubricant on the surface of the image carrying member 10.

In the image forming apparatus according to the embodiment 3, the lubricant is supplied to the surface of the image carrying member 10 from the recording medium 51, as described above. Accordingly, an apparatus for supplying the lubricant need not be provided around the image carrying member 10. Even when the image carrying member 10 having a small diameter is used, the lubricant can be suitably supplied to the surface of the image carrying member 10.

An image forming apparatus in an example 3 so adapted as to supply a lubricant to a surface, to which a toner image formed on an image carrying member 10 is transferred, of a recording medium 51, as described above, and an image forming apparatus in a comparative example 3 in which no lubricant is supplied are compared with each other, to clarify that noise or the like due to insufficient cleaning is prevented from appearing in the formed toner image in the image forming apparatus in the example 3.

EXAMPLE 3 AND COMPARATIVE EXAMPLE 3

In the image forming apparatuses in the example 3 and the comparative example 3, a commercial color copying machine (CF900: manufactured by Minolta Camera Co., Ltd.) was converted, to bring a brush 82 into contact with a surface, to which a toner image formed on an image carrying member 10 is transferred, of a recording medium 51 such that the contact length of its bristles would be approximately 1 mm at a position on the upstream side in the direction of conveyance of a recording medium 51 from a feed roller 52, and the brush 82 was rotated at a speed of 10 r.p.m. so as to be moved in the same direction as the direction of conveyance of the recording medium 51 in a portion in contact with the recording medium 51.

In the image forming apparatus in the example 3, used as a lubricant was a molding 81 in the shape of a rectangular parallelepiped having dimensions of 5 mm by 5 mm by 300 mm obtained by classifying calcium stearate powder (CS-P: produced by Sinagawa Kasei K.K.) using a screen vibrator, to obtain calcium stearate powder containing not less than 80% by volume of particles having a particle diameter in a range of 3 $\mu$m to 20 $\mu$m, and solidifying the obtained calcium stearate powder.

In the image forming apparatus in the example 3, the molding 81 of the lubricant was pressed against the brush 82 by a pressing force of approximately 200 gf. As shown in the above-mentioned embodiment 3, the lubricant was scraped off the molding 81 of the lubricant by the brush 82, and was supplied from the brush 82 to the surface, to which the toner image formed on the image carrying member 10 is transferred, of the recording medium 51.

On the other hand, in the image forming apparatus in the comparative example 3, the above-mentioned lubricant was not used. The lubricant was not supplied to the surface, to which the toner image formed on the image carrying member 10 is transferred, of the recording medium 51.

A plate wear test of 60,000 paper sheets was carried out by each of the image forming apparatuses in the example 3 and the comparative example 3, to evaluate a formed toner image.

As a result, in the image forming apparatus in the example 3, at the time point where a toner image was formed on 60,000 paper sheets, no noise due to insufficient cleaning appeared in the formed toner image. Contrary to this, in the image forming apparatus in the comparative example 2, at the time point where a toner image was formed on approximately 30,000 paper sheets, noise due to insufficient cleaning appeared in the formed toner image.

(Embodiment 4)

In an image forming apparatus according to an embodiment 4, a lubricant containing not less than 80% by volume of particles having a particle diameter in a range of 3 $\mu$m to 20 $\mu$m, together with toners 41, is added to the developing device 40 in the conventional image forming apparatus shown in FIG. 1.

In the image forming apparatus according to the embodiment 4, toners 41 are supplied to a surface, on which an electrostatic latent image has been formed, of an image carrying member 10 from a developing device 40, to form a toner image corresponding to the electrostatic latent image on the surface of the image carrying member 10 as well as to supply the lubricant to the surface of the image carrying member 10.

The toner image formed on the surface of the image carrying member 10 is then transferred to a recording medium 51 by a transferring device 50. Thereafter, a pressing member 70 in a plate shape is pressed against the surface of the image carrying member 10 after the transfer, to remove the toners 41 or the like remaining on the surface of the image carrying member 10 from the surface of the image carrying member 10 and roll the lubricant supplied to the surface of the image carrying member 10, thereby forming a film of the lubricant on the surface of the image carrying member 10.

When the lubricant containing not less than 80% by volume of particles having a particle diameter in a range of 3 μm to 20 μm is supplied to the surface of the image carrying member 10, as in the image forming apparatus according to the embodiment 4, much of the lubricant supplied to the surface of the image carrying member 10 is introduced into a portion between the pressing member 70 and the image carrying member 10 and is suitably rolled. Accordingly, the lubricant is hardly uselessly used, and the film of the lubricant is suitably formed on the surface of the image carrying member 10.

Although in the image forming apparatus according to the embodiment 4, the lubricant containing not less than 80% by volume of particles having a particle diameter in a range of 3 μm to 20 μm, together with the toners 41, is added to the developing device 40, and the lubricant, together with the toners 41, is supplied to the surface of the image carrying member 10, a method of supplying the lubricant to the surface of the image carrying member 10 is not particularly limited.

For example, a molding 81 obtained by solidifying the lubricant containing not less than 80% by volume of particles having a particle diameter in a range of 3 μm to 20 μm by only pressure without melting the particles of the lubricant is used. As in the above-mentioned image forming apparatuses shown in FIGS. 2 to 4, it is also possible to scrape the lubricant off the molding 81 of the lubricant by the brush 82, and supply the lubricant containing not less than 80% by volume of particles having a particle diameter in a range of 3 μm to 20 μm to the surface of the image carrying member 10. As in the image forming apparatus shown in FIG. 5, it is also possible to supply the lubricant which has been scraped off the molding 81 of the lubricant by the brush 82 to the recording medium 51, and supply the lubricant containing not less than 80% by volume of particles having a particle diameter in a range of 3 μm to 20 μm to the surface of the image carrying member 10 from the recording medium 51.

Figure 6:
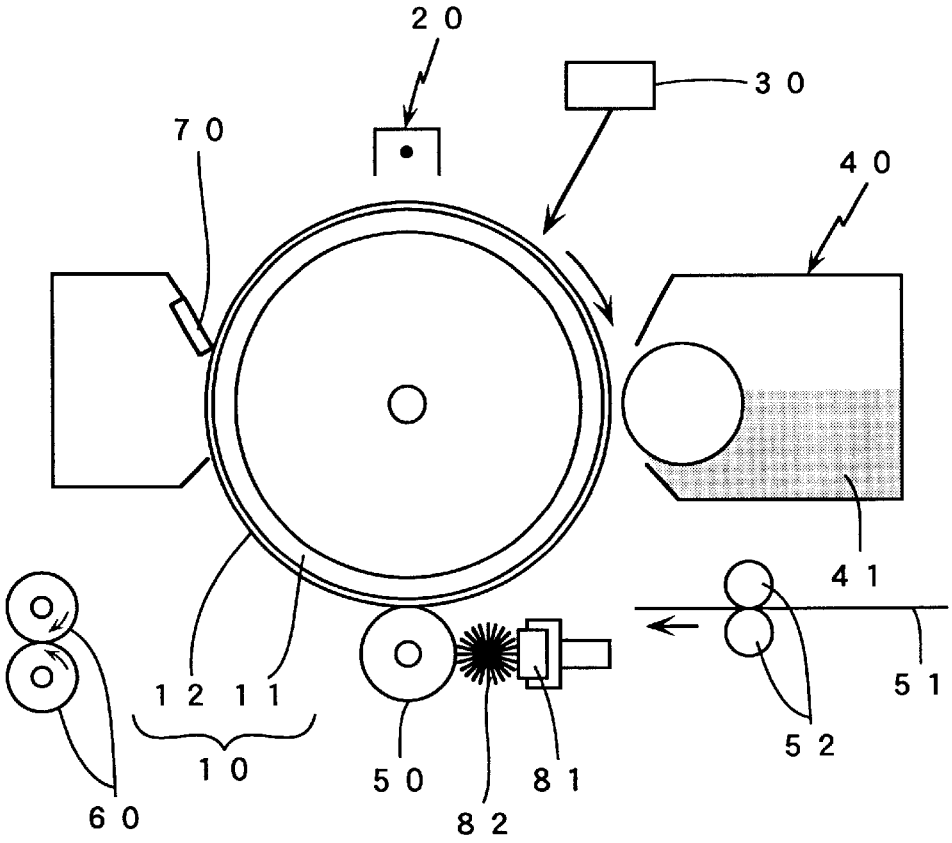
FIG. 6 is a schematic illustration of an image forming apparatus for supplying a lubricant scraped off a molding of a lubricant by a brush to a surface of an image carrying member through a transfer roller in an embodiment of the present invention.

Furthermore, it is also possible to supply the lubricant containing not less than 80% by volume of particles having a particle diameter in a range of 3 μm to 20 μm which has been scraped off the molding 81 of the lubricant by the brush 82, and supply the lubricant to the surface of the image carrying member 10 through the transferring device 50, as shown in FIG. 6. In a case where the toner image formed on the surface of the image carrying member 10 is transferred to the recording medium 51, only when the recording medium 51 exists between the image carrying member 10 and the transferring device 50, the lubricant supplied to the transferring device 50 is not supplied to the image carrying member 10, and no toner image is formed on the surface of the image carrying member 10, the transferring device 50 is brought into contact with the image carrying member 10. Accordingly, the lubricant is supplied to the surface of the image carrying member 10, thereby preventing the lubricant and the toners 41 from being mixed and stored in a contact portion between the pressing member 70 and the image carrying member 10.

EXAMPLE 4 AND COMPARATIVE EXAMPLE 5

In image forming apparatuses in an example 4 and comparative examples 4 and 5, toners produced in the following manner were used.

Polyester resin having a number-average molecular weight of 4800, having a weight-average molecular weight of 19200, having a glass transition point of 58° C., and having a softening point of 100° C. and a cyan coloring agent (C.I. Pigment Blue 15-3: produced by Toyo Ink Mfg. Co., Ltd.) were put in a pressing kneader in a weight ratio of 7 to 3 and were kneaded, and the resulting kneaded mixture was ground by a feather mill, to obtain a masterbatch. 10% by weight of the masterbatch and 3% by weight of the polyester resin were mixed by a Herschel mixer, and the resulting mixture was kneaded by a biaxial extruding kneader. The kneaded mixture was cooled, was then coarsely ground by the feather mill, was further finely ground by a jet mill, and was classified, to obtain toner particles having a volume-average particle diameter of 8.0 μm . 1 part by weight of silica (R974: produced by Nippon Aerozil K.K.) and 1 part by weight of titania (A-11: produced by Titan Kogyo) were then added as fluidizing agents to 100 parts by weight of the toner particles, followed by agitation for two minutes with the number of revolutions of an agitating blade set to 2000 r.p.m. by the Herschel mixer, to obtain cyan toners.

In adding calcium stearate powder (CS-P: produced by Shinagawa Kako K.K.) as a lubricant to the toners obtained in the above-mentioned manner, the calcium stearate powder was classified by a screen vibrator. Calcium stearate powder containing approximately 90% by volume of particles having a particle diameter in a range of 3 μm to 20 μm, calcium stearate powder containing approximately 80% by volume of particles having a particle diameter of not more than 3 μm, and calcium stearate powder containing approximately 90% by volume of particles having a particle diameter of not less than 20 μm were respectively used in the example 4, the comparative example 4, and the comparative example 5.

0.1 parts by weight of each calcium stearate powder was added to 100 parts by weight of the toners, followed by agitation for 30 seconds with the number of revolutions of the agitating blade set to 2000 r.p.m. by the Herschel mixer.

A developing device in a commercial color copying machine (CF900: manufactured by Minolta Camera Co., Ltd.) was then filled with a mixture of the calcium stearate powder with the toners. A plate wear test of 60,000 paper sheets was carried out, to evaluate a formed toner image.

As a result, in the image forming apparatus in the example 4 in which the calcium stearate powder containing approximately 90% by volume of particles having a particle diameter in a range of 3 μm to 20 μm was added to the toners, even at the time point where a toner image was formed on 60,000 paper sheets, no noise due to insufficient cleaning appeared in the formed toner image. Contrary to this, in the image forming apparatus in the comparative example 4 in which the calcium stearate powder containing approximately 80% by volume of particles having a particle diameter of not more than 3 μm was added to toners, at the time point where a toner image was formed on approximately 40,000 paper sheets, noise due to insufficient cleaning appeared in the formed toner image. Further, in the image forming apparatus in the comparative example 5 in which the calcium stearate powder containing approximately 90% by volume of particles having a particle diameter of not less than 20 μm was added to the toners, at the time point where a toner image was formed on approximately 35,000 paper sheets, noise due to insufficient cleaning appeared in the formed toner image.

Although in the example 4 and the comparative examples 4 and 5, the lubricant was added to the toners 41, and the lubricant, together with the toners 41, was supplied to the surface of the image carrying member 10, a molding 81 obtained by solidifying the lubricant by only pressure without melting the particles of the lubricant may be used, and the lubricant may be scrapped off the molding 81 of the lubricant by the brush 82 and supplied to the surface of the image carrying member 10, in which case similar results are also obtained.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member for carrying an electrostatic latent image which is formed on a surface of the image carrying member;

a developing device for developing the electrostatic latent image by toners in order to form a toner image on the image carrying member;

a transferring device for transferring the toner image from the image carrying member to a surface of a transferred medium;

a cleaning blade for separating toners remaining on the image carrying member after the tone image is transferred to the surface of the transferred medium; and a lubricant supplying device for supplying lubricant particles to the image carrying member, at least 80% by volume of the lubricant particles having a particle diameter in a range of 3 $\mu$m to 20 $\mu$m .

2. The image forming apparatus according to claim 1, wherein at least 90% by volume of the lubricant particles have the particle diameter in the range of 3 $\mu$m to 20 $\mu$m.

3. The image forming apparatus according to claim 1, wherein the lubricant supplying device is arranged between the transferring device and the cleaning blade.

4. The image forming apparatus according to claim 1, wherein the lubricant supplying device supplies the lubricant particles to the image carrying member in a non-image-forming period.

5. The image forming apparatus according to claim 4, wherein the non-image-forming period is from switching on the image forming apparatus till starting a first image forming operation.

6. The image forming apparatus according to claim 4, wherein the non-image-forming period is between a first image-forming period and a second image-forming period.

7. The image forming apparatus according to claim 1, wherein the lubricant supplying device supplies the lubricant particles to the image carrying member in a non-image-forming period and stops supplying the lubricant particles to the image carrying member in an image-forming period.

8. The image forming apparatus according to claim 1, wherein the lubricant supplying device comprises a rotating member and a lubricant supporting member supporting a molding obtained by solidifying the lubricant particles, the rotating member being arranged in contact with the image carrying member and the molding, and the rotating member scraping the lubricant particles from the molding and supplying the lubricant particles to the image carrying member.

9. The image forming apparatus according to claim 1, wherein the lubricant supplying device supplies the lubricant particles to a portion, where the toner image is formed, of the image carrying member.

10. The image forming apparatus according to claim 1, wherein the lubricant particles are fatty acid metal salt particles.

11. The image forming apparatus according to claim 10, wherein the fatty acid metal salt particles are calcium stearate particles.

12. An image forming apparatus comprising:

an image carrying member for carrying an electrostatic latent image which is formed on a surface of the image carrying member;

a developing device for developing the electrostatic latent image by toners in order to form a toner image on the image carrying member;

a transferring device comprising a transferring roller for transferring the toner image from the image carrying member to a surface of a transferred medium;

a cleaning blade for separating toners remaining on the image carrying member after the tone image is transferred to the surface of the transferred medium; and a lubricant supplying device for supplying lubricant particles to the transferring roller, at least 80% by volume of the lubricant particles having a particle diameter in a range of 3 $\mu$m to 20 $\mu$m.

13. The image forming apparatus according to claim 12, wherein at least 90% by volume of the lubricant particles have the particle diameter in the range of 3 $\mu$m to 20 $\mu$m.

14. The image forming apparatus according to claim 12, wherein the lubricant supplying device comprises a rotating member and a lubricant supporting member supporting a molding obtained by solidifying the lubricant particles, the rotating member being arranged in contact with the transferring roller and the molding, and the rotating member scraping the lubricant particles from the molding and supplying the lubricant particles to the transferring roller.

15. An image forming apparatus comprising:

an image carrying member for carrying on electrostatic latent image which is formed on a surface of the image carrying member;

a developing device for developing the electrostatic latent image by toners in order to form a toner image on the image carrying member;

a transferring device for transferring the toner image from the image carrying member of a surface of a recording paper;

a cleaning blade for separating toners remaining on the image carrying member after the toner image is transferred to the surface of the recording paper; and p1 a lubricant supplying device for supplying lubricant particles to the recording paper before the toner image is transferred to the surface of the recording paper.

16. The image forming apparatus according to claim 15, wherein at least 80% by volume of the lubricant particles have the particle diameter in the range of 3 $\mu$m to 20 $\mu$m.

17. The image forming apparatus according to claim 15, wherein the lubricant supplying device comprises a lubricant supporting member supporting a molding obtained by solidifying the lubricant particles and a rotating member being arranged in contact with the molding, and the rotating member scraping the lubricant particles from the molding and supplying the lubricant particles to the transferred medium.

18. An image forming method comprising:

forming a toner image on an image carrying member;

transferring the toner image from the image carrying member to a surface of a transferred medium;

separating toners remaining on the image carrying member by a cleaning blade; and supplying lubricant particles to the image carrying member, at least 80% by volume of the lubricant particles having a particle diameter in a range of 3 $\mu$m to 20 $\mu$m.

19. The image forming method according to claim 18, wherein:

at least 90% by volume of the lubricant particles have the particle diameter in the range of 3 $\mu$m to 20 $\mu$m.

* * * * *